United States Patent [19]

Schneider

[11] 4,397,063

[45] Aug. 9, 1983

[54] METHOD FOR RESTRAINING TRANSVERSE MOVEMENT OF THE LOWER EDGES OF VERTICALLY HUNG SLIDING DOORS

[76] Inventor: Robert L. Schneider, 1876 Fireside Dr., Cincinnati, Ohio 45230

[21] Appl. No.: 213,857

[22] Filed: Dec. 8, 1980

[51] Int. Cl.[3] ..... E05D 13/02

[52] U.S. Cl. ..... 16/90; 49/411; 411/373

[58] Field of Search ..... 16/90, 94 R, 96 R, 100; 49/411; 411/371, 372, 373, 377, 480

[56] References Cited

U.S. PATENT DOCUMENTS

| | | | |
|---|---|---|---|
| 1,152,960 | 9/1915 | Moloney | 411/373 |
| 1,801,077 | 4/1931 | Gentry | 411/377 |
| 2,929,115 | 3/1960 | Beckstrom | 49/411 |
| 2,939,167 | 6/1960 | Preston | 16/90 |
| 2,988,787 | 6/1961 | Migneault et al. | 16/90 X |
| 3,205,529 | 9/1965 | Vintan | 16/90 |
| 3,298,272 | 1/1967 | Henderson | 411/373 |
| 3,345,677 | 10/1967 | Milette | 16/90 |
| 3,493,990 | 2/1970 | Winn | 16/90 |

FOREIGN PATENT DOCUMENTS

| | | | |
|---|---|---|---|
| 1020232 | 11/1952 | France | 411/373 |
| 835096 | 5/1960 | United Kingdom | 411/373 |
| 1394225 | 5/1975 | United Kingdom | 16/90 |

*Primary Examiner*—Fred Silverberg
*Attorney, Agent, or Firm*—Frost & Jacobs

[57] ABSTRACT

A method for restraining transverse movement of the lower edges of a vertically hung sliding door which includes providing a nail-like pin driven into the flooring adjacent the lower edge of the door and a formed resilient cap force fitted over the top of the pin and having surfaces for slidingly abutting the lower edges of the door. The guides may be positioned at selected locations along the path of travel of the door, and may be accurately located by use of a template.

3 Claims, 8 Drawing Figures

METHOD FOR RESTRAINING TRANSVERSE MOVEMENT OF THE LOWER EDGES OF VERTICALLY HUNG SLIDING DOORS

SUMMARY OF THE INVENTION

The present invention is related to means for guiding the lower edges of sliding doors to prevent displacement of the doors in directions transverse to their direction of travel.

In a conventional sliding door installation, a pair of vertically hung horizontally spaced doors are supported at their upper ends for sliding movement in directions generally parallel to the plane of the doors. Doors of this type are commonly used for closets in order to access both sides of the closet space.

As a generaly rule, sliding doors of this type are unsupported along their lower edges, and require means for preventing movement of the lower edges of the doors in directions transverse to their normal direction of travel.

One common method of guiding the lower edges of sliding doors is to provide a track having three spaced upwardly extending guide members which is fixedly secured to the floor by nails or screws to provide parallel guideways slidingly accepting the lower edges of the doors. Since the lower edges of the doors are usually positioned in closely spaced relation to the floor surface, such tracks have been found difficult to install, particularly if the track is constructed in one piece. In this situation, the track must be slid beneath the lower edges of the door and fastened in place. This is often a difficult procedure and can lead to damage to the door, track or both.

Alternatively, it has been proposed to make parts of the door guide track removable to facilitate installation. Examples of this type of construction are disclosed in U.S. Pat. No. 2,939,167 issued June 7, 1960 to D. F. Preston and U.S. Pat. No. 3,205,529 issued Sept. 14, 1965 to J. Vintan.

Regardless of the type of track which is used, difficulties have been found to be particularly pronounced for installations over existing carpet. Installations of this type also require special shims, and may cause unraveling of the carpet in the area of the door guide track. Furthermore, the workman must stock a variety of track sizes to accommodate various door installations, particularly where the guide is being replaced in an existing installation.

The sliding door guide of the present invention seeks to overcome problems of the type described above by providing a simple, inexpensive, and easily installed guide for the lower edges of sliding doors. In a preferred embodiment, the guide of the present invention includes a number of nail-like pins which are forceably driven into the floor adjacent the outer and inner edges of each door. The lower end of the pin is provided with a pointed or hardened end permitting it to be securely driven into a wood or concrete floor, even through overlying carpet and padding.

To insure accurate placement of the pins, a disposable or reusable template may be provided with openings corresponding to the positions that the driven pins must occupy to insure accurate guiding of the lower edge of the door, while preventing unnecessary sliding restriction.

Once the pins are placed, they may be provided with a formed plastic or rubber cap having a central bore enabling the cap to be force fitted over the upper end of the pin. Each cap includes smooth outer surfaces configured to slidingly engage the inner or outer edges of the door to permit free sliding movement.

From the detailed description which follows, various embodiments of the pin and cap structure are disclosed.

BRIEF DESCRIPTION OF THE DRAWING

FIG. 8 is a front elevational view of a third embodiment of the pin associated with the sliding door guide of the present invention.

DETAILED DESCRIPTION

Figure 1:
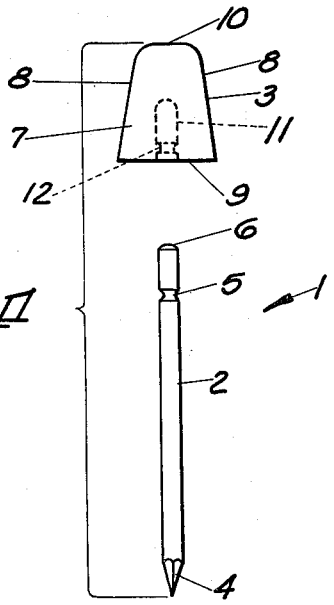
FIG. 1 is an enlarged exploded front elevation view of a first embodiment of the sliding door guide of the present invention.

A first embodiment of the sliding door guide of the present invention is illustrated generally at 1 in FIG. 1 and comprises a generally cylindrical elongated nail-like pin 2 with a cooperating formed cap 3 forceably secured to the upper end of pin 2. Pin 2 may be fabricated from steel, brass, copper or the like of sufficient strength to be driven into a suitable floor as will be described hereinafter. Each pin 2 is several inches long and provided with a securing means at one end enabling the pin to be forceably driven into the floor adjacent the lower edge of the door. In the embodiment of FIG. 1, the lower end of pin 2 is provided with a sharpened point 4 which enables the pin to be forceably driven into a wood or tile floor.

The opposite end of pin 2 is provided with gripping means in the form of a groove 5 circumferentially inscribed around the pin and spaced from the upper end, which may be rounded as at 6.

Cap 3 may be formed from plastic, rubber or other resilient material in the shape of a trapezoidal prism having spaced vertically extending front and rear smooth surfaces 7, and connecting side surfaces 8. The base of cap 3 may be flattened as at 9, while the upper portion is generally rounded as at 10. As will be explained in more detail hereinafter, front and rear faces 7 are configured to slidingly engage the lower edges of the doors. Consequently, the finish of the surfaces, as well as the material chosen for the cap, will be such as to insure generally frictionless contact between the door and the cap.

Cap 3 is also provided with a vertically extending central bore 11 having an inwardly projecting circumferential lip 12. After pin 2 has been secured to the floor, cap 3 may be slid downwardly over the upper end of the pin to provide a force fit between the cap and pin, with lip 12 engaging groove 5 to hold the cap securely in place. When properly positioned, cap 3 will be aligned such that the front or rear surface is parallel to the plane of the adjacent sliding door.

Figure 3:
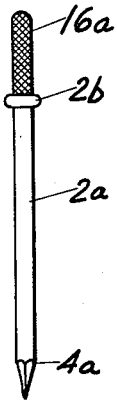
FIG. 3 is a front elevational view of a second embodiment of the pin associated with the sliding door guide of the present invention.
Figure 3:
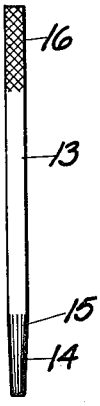

A second embodiment of the pin associated with the guide 1 of the present invention is illustrated at 13 in FIG. 3, and includes a hardened lower end or termination 14 for forceably driving the pin into a floor constructed of concrete or the like. Hardened end 14 may also be provided with a number of grooves or striations 15 to enhance the holding ability of the pin. The opposite or upper end of pin 13 may be provided with a knurled portion 16 which cooperates with interior bore 11 of cap 3, with or without inwardly extending projections 12, to provide a force fit between the cap and the pin.

Figure 4:
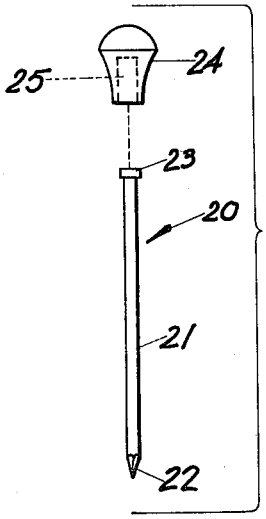
FIG. 4 is an enlarged exploded front elevation view of another embodiment of the sliding door guide of the present invention.
Figure 5:
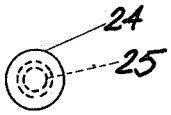
FIG. 5 is a top plan view of the cap of the sliding door guide of FIG. 4.

Another embodiment of the guide of the present invention is illustrated generally at 20 in FIG. 4, and comprises a nail-like pin 21 having a lower pointed end 22, and a flanged head 23 on the opposite end of pin 21. Guide 20 also includes a cap 24 of plastic, rubber or other resilient material having an interior bore 25 dimensioned to cooperate with flanged head 23 to hold the cap securely in place. In this embodiment, cap 24 is formed in a knob-like shape of generally round cross section for providing an exterior surface which cooperates with the outer surfaces of the sliding doors to prevent movement of the doors in directions transverse to their normal direction of travel.

Figure 2:
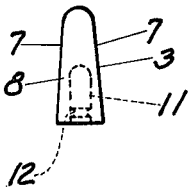
FIG. 2 is a side elevation view of the cap associated with the sliding door guide of FIG. 1.

A fourth embodiment of the pin of the present invention is illustrated in FIG. 8 and comprises a nail-like pin **2*a* having a lower pointed end 4*a* and an upper knurled portion 16*a*. An outwardly extending flange or rim 2*b* is positioned at the lower edge of knurled portion 16*a* and serves as a stop to position a cap, such as cap 3 illustrated in FIG. 2, at the proper vertical position. It will be understood that the lower end 4*a* of the embodiment of FIG. 8 may also be provided with a hardened portion as in the embodiment of FIG. 3**.

Figure 6:
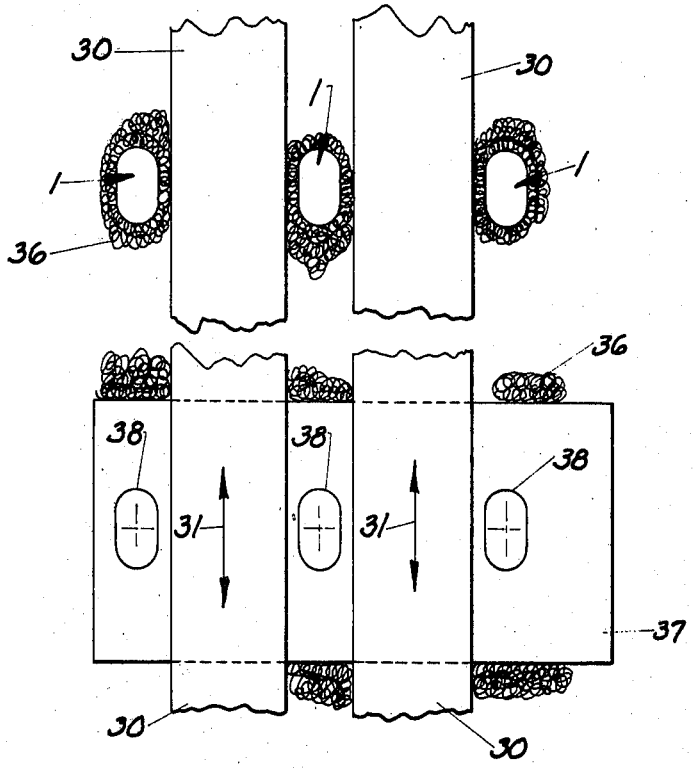
FIG. 6 is a fragmentary top plan view of a sliding door installation using the guide of the present invention.
Figure 7:
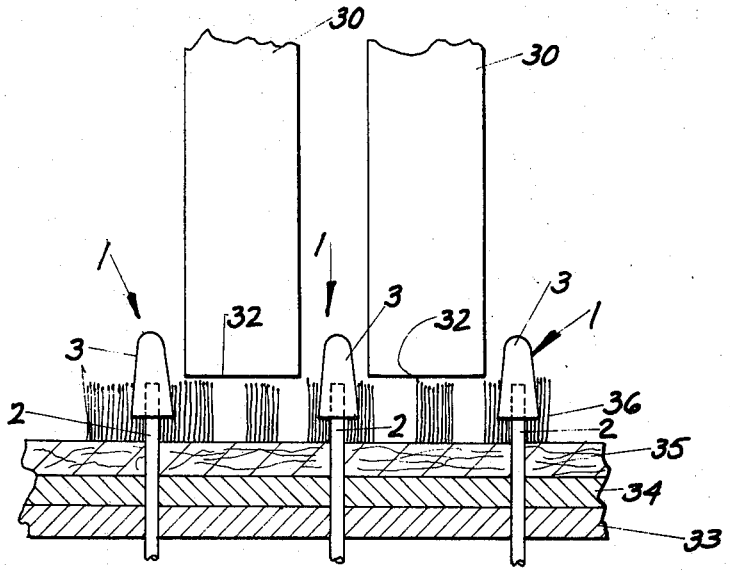
FIG. 7 is a fragmentary partially cross sectioned end elevation view of the installation of FIG. 6.

A preferred method of installing the guide of the present invention is illustrated in FIG. 6 and FIG. 7 where elements similar to those previously described have been similarly designated. In the installation illustrated, a pair of vertically hung horizontally spaced sliding doors 30 are suspended by sliding means (not shown) for sliding movement in the direction of directional arrows 31. The lower edges 32 of doors 30 overlie a floor structure composed of a subfloor 33, finish flooring 34, carpet padding 35, and carpeting 36. It will be observed that a slight space is provided between the lower surfaces of lower edges 32 of the doors and the upper surfaces of carpet 36, as is conventional practice.

As best shown in FIG. 6, a paper or plastic template 37 may be provided to accurately locate the position of guides 1. The template bears indicia 38 spaced a distance apart corresponding to a dimension slightly greater than the width of doors 30. In one embodiment, template 37 may be disposable and fabricated from paper or the like, with indicia 38 comprising a cross or other marking. Beginning with the location between spaced doors 30, a pin 2 is forceably driven through carpet 36, pad 35 and finish floor 34 into subfloor 33, such that the upper end of pin 2 is spaced below the lower edge 32 of the doors. In general, pin 2 will be positioned so as to be equidistant from each door. The process is then repeated for the indicia locations lying on the outside of the doors, again, insuring that the pins 2 are placed so as to prevent excessive lateral or transverse movement of the doors. In the case of a disposable paper template, the template may merely be ripped away from the pins. In an alternative embodiment, indicia 38 may comprise round or elongated holes so that the template can be slipped off of the pins 2 and reused. It will be observed that this arrangement permits the doors 30 to be pushed apart to facilitate driving the pins 2 in place. Once the pins are driven into the subflooring, the doors may be released to return to their normal plumb position, with the lower edges 32 of the doors passing easily over the upper ends of the pins 2.

After the pins have been driven into place, a cap 3 may be snapped over the upper end of each pin with front and rear surfaces 7 positioned in facing relationship with the surfaces of the doors as illustrated in FIG. 7, such that the body portion of the cap is above the lower edges 32 of the doors.

It will be understood that the same type of installation may be utilized with concrete floors, using a pin of the type illustrated in FIG. 3 having a hardened lower end. In some instances, it may be necessary to drill a guide hole in the concrete flooring and use an expandable anchor to securely hold the pin in place.

In any event, it will be understood that the guides of the present invention greatly simplify installation, and usually require only a hammer for placing the guide pins in the underlying floor.

It will be further understood that various changes in the details, materials, steps and arrangements of parts, which have been herein described and illustrated in order to explain the nature of the invention, may be made by those skilled in the art within the principle and scope of the invention as expressed in the appended claims. For example, while for purposes of an exemplary showing, the guide of the present invention has been described and illustrated as having separate pin and cap portions, it will be understood that the guide may be fabricated in one piece, with the upper surface of the cap portion being struck by a driving tool to forceably drive the pin portion into place in the floor. In some installations, it may be desirable to use the guide having a separate cap to prevent marring of the outer surface to provide a pleasing exterior surface apeparance.

The embodiments of the invention in which an exclusive property or privilege is claimed are as follows:

1. A method for guiding the lower side edges of a pair of vertically hung horizontally spaced doors supported for sliding movement in directions generally parallel to the plane of the doors to prevent excessive movement of the lower side edges in directions transverse to their direction of travel, said method comprising, providing at selected locations adjacent the inner and outer lower side edges of the doors a nail-like guide pin having a lower end configured to be forcibly driven into and fixedly secured to the floor and an upper end bearing an enlarged portion having surfaces for slidingly engaging the lower side edges of the door, forcibly driving into the floor adjacent the lower side edges of the door said nail-like guide pin, said upper end of said nail-like guide pin having a vertical height less than the distance between said floor and a lower bottom edge of said door such that said door may be pivoted sideways to clear the pin and enable other pins to be driven into the floor, and securing to the upper end of the pin after it has been driven into the floor a cap comprising said enlarged portion having outer surfaces configured to slidingly abut a lower side edge surface of the associated door, said cap being removable to enable removal of the doors.

2. The method according to claim 1 wherein said pins are located by means of a template bearing indicia for accurately positioning the pins to prevent interference with the sliding movement of the doors and prevent excessive movement of the doors in directions transverse to their direction of travel.

3. The method according to claim 1 wherein said indicia comprises openings in the template, said template being removed from the pins after installation is complete.

* * * * *